US006378721B1

(12) United States Patent
Williams

(10) Patent No.: US 6,378,721 B1
(45) Date of Patent: Apr. 30, 2002

(54) COMPARTMENTALIZED TRASH CAN FOR SORTING AND STORING DIFFERENT KINDS OF RECYCLABLES

(76) Inventor: Keith Williams, 240-08 145th Ave., Rosedale, NY (US) 11422

( * ) Notice: Subject to any disclaimer, the term of this patent is extended or adjusted under 35 U.S.C. 154(b) by 0 days.

(21) Appl. No.: 09/752,482

(22) Filed: Jan. 2, 2001

(51) Int. Cl.[7] ..... B65D 1/24; B65D 25/14

(52) U.S. Cl. ..... 220/495.08; 220/523; 220/909

(58) Field of Search ..... 220/909, 908.1, 220/264, 263, 495.07, 495.08, 498.09, 498.11, 495.06

(56) References Cited

U.S. PATENT DOCUMENTS

| | | | | | |
|---|---|---|---|---|---|
| 4,905,853 | A | * | 3/1990 | Strander | 220/909 |
| 4,913,308 | A | * | 4/1990 | Culbertson | 220/909 |
| 5,190,183 | A | * | 3/1993 | McNaughton et al. | 220/909 |
| 5,246,119 | A | * | 9/1993 | Heffner | 220/909 |
| 5,320,241 | A | * | 6/1994 | Evans | 220/909 |
| 5,558,254 | A | * | 9/1996 | Anderson et al. | 220/909 |
| 5,871,114 | A | * | 2/1999 | Anderson et al. | 220/909 |
| 6,024,240 | A | * | 2/2000 | Howard et al. | 220/909 |

* cited by examiner

*Primary Examiner*—Joseph M. Moy

(57) ABSTRACT

A compartmentalized trash can for sorting and storing different kinds of recyclables. A plurality of partitions are disposed in, and divide, a container into a plurality of sub-chambers. A lid is hingedly attached to, and selectively opens and closes the container. An apparatus opens the lid by use of a foot of a user. A liner bag removably lines the container and is defined by a peripheral flange, and includes a plurality of sub-liner bags that are formed together as one piece, with each sub-liner bag lining an associated sub-chamber. Each sub-liner bag is defined by a flange. The flanges of adjacent sub-liner bags are common, and solely by themselves, without any other attachments, attach the plurality of sub-liner bags to each other. The flanges of the plurality of sub-liner bags are divided lengthwise by perforations. When the plurality of sub-liner bags are inserted into associated sub-chambers, and the peripheral flange of the liner bag rests on the container, and the flanges of the plurality of sub-liner bags rest on the plurality of partitions, and the plurality of sub-liner bags become filled with the different kinds of recyclable, then the perforations in the plurality of sub-liner bags are severed, separating them from each other for independent removable, closing, and processing. A hoop removably secures the peripheral flange of the liner bag onto the container, prior to removal thereof.

12 Claims, 1 Drawing Sheet

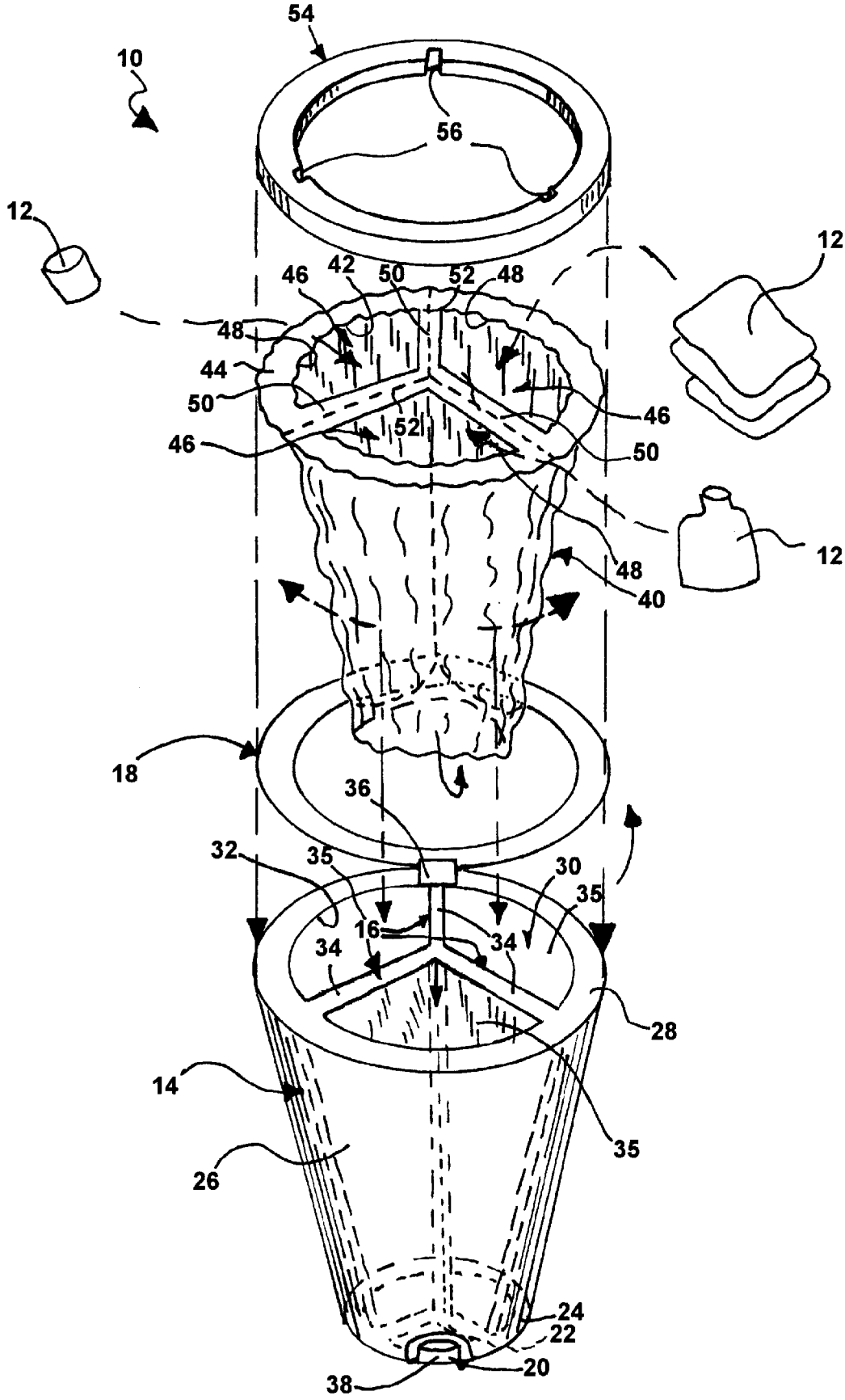
54
10
56
12
12
46
42
50
52
48
48
44
50
46
52
46
50
12
48
40
18
36
32
35
30
35
16
34
34
28
14
35
26
24
22
20
38

COMPARTMENTALIZED TRASH CAN FOR SORTING AND STORING DIFFERENT KINDS OF RECYCLABLES

CROSS REFERENCE TO RELATED APPLICATION

The instant application is a refile of application No. 09/290,415, filed Apr. 13, 1999, entitled COMPARTMENTALIZED TRASH CAN FOR SORTING AND STORING DIFFERENT KINDS OF RECYCLABLES, and now abandoned.

BACKGROUND OF THE INVENTION

1. Field of the Invention

The present invention relates to a trash can. More particularly, the present invention relates to a compartmentalized trash can for sorting and storing different kinds of recyclables.

2. Description of the Prior Art

Considering the rapidly deteriorating ecological conditions due to waste incineration, underground water contamination from garbage landfills and ocean dumping, there is obviously a serious waste management problem.

A large portion of trash can be reclaimed, recycled, and resold. Traditionally, waste containers have not been designed to facilitate the source separation required for highly effective recycling programs to be successful, nor have they incorporated the convenience required to encourage wide spread, willing participation.

Numerous innovations for containers have been provided in the prior art that will be described. Even though these innovations may be suitable for the specific individual purposes to which they address, however, they differ from the present invention.

FOR EXAMPLE, U.S. Pat. No. 4,905,853 to Strawder teaches a trash can that has a rim at its upper end. A divider, made up of a plurality of arms, cooperates with the rim to form a plurality of open spaces at the top of the can. The arms of the divider are supported by sockets mounted on the rim. Plastic trash bags hang below the open spaces. The bags are supported by projections or hooks on the divider and on the rim of the can. A cover or lid for the trash can has a generally vertical sidewall having a door above each trash bag.

ANOTHER EXAMPLE, U.S. Pat. No. 4,953,740 to Koda teaches a wastebasket which includes a container, a lid pivotably mounted to the container, by a hinge, a foot-operated actuating mechanism for opening and closing the lid, and a projection extending from the bottom of the lid to prevent a trash liner secured to the container from interfering with either the hinge or the actuating mechanism. The projection also protects the actuating mechanism from becoming soiled and the lid from bouncing excessively when the lid is opened with too much force.

STILL ANOTHER EXAMPLE, U.S. Pat. No. 4,974,746 to Dickenson teaches a waste separation container that selectively separates and stores waste material that includes a receptacle with an upper edge with slits in it opening upwardly to receive and hold a plurality of thin plastic bags in an open position. The slits are preferably defined by flexible lobes, contiguous one another and extending along the upper edge of the receptacle. Preferably, a closure for the receptacle is provided that has specifically designated through apertures that allow for discernable placement of recyclable material in a correspondingly appropriate compartment or bag. The provision of strips of flexible material with lobes defining between them bag-retaining slits, either to be mounted on existing containers, on partitions for existing containers or holders to be placed in existing containers permits retro-fitting of existing waste receptacles to accomplish the object of making easy the segregation of waste as it is generated.

FINALLY, YET ANOTHER EXAMPLE, U.S. Pat. No. 5,119,958 to Gabert et al. teaches a sort and cycle bin for waste materials which consists of a receptacle having a front wall, a rear wall, a bottom wall and a pair of side walls with a plurality of horizontally oriented and vertically spaced apart compartments. Indicia is associated with the compartments, for visually indicating the type of waste material to be placed in each compartment. A removable container is to be placed into each compartment for receiving one type of waste material that will be placed therein. A mechanism is for suspending each of the removable containers within each of the compartments. Each of the different waste materials can be placed into each of the removable containers and then be removed to facilitate its transportation to a recycling facility. A lid is hinged to a top edge of the rear wall of the receptacle, so that when the lid is placed in a closed position it will cover the compartments.

It is apparent that numerous innovations for containers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a compartmentalized trash can for sorting and storing different kinds of recyclables that avoids the disadvantages of the prior art.

ANOTHER OBJECT of the present invention is to provide a compartmentalized trash can for sorting and storing different kinds of recyclables that is simple and inexpensive to manufacture.

STILL ANOTHER OBJECT of the present invention is to provide a compartmentalized trash can for sorting and storing different kinds of recyclables that is simple to use.

BRIEFLY STATED, YET ANOTHER OBJECT of the present invention is to provide a compartmentalized trash can for sorting and storing different kinds of recyclables. A plurality of partitions are disposed in, and divide, a container into a plurality of sub-chambers. A lid is hingedly attached to, and selectively opens and closes the container. An apparatus opens the lid by use of a foot of a user. A liner bag removably lines the container and is defined by a peripheral flange, and includes a plurality of sub-liner bags that are formed together as one piece, with each sub-liner bag lining an associated sub-chamber. Each sub-liner bag is defined by a flange. The flanges of adjacent sub-liner bags are common, and solely by themselves, without any other attachments, hold the plurality of sub-liner bags to each other. The flanges of the plurality of sub-liner bags are divided lengthwise by perforations. When the plurality of sub-liner bags are inserted into associated sub-chambers, and the peripheral flange of the liner bag rests on the container, and the flanges of the plurality of sub-liner bags rest on the plurality of partitions, and the plurality of sub-liner bags become filled with the different kinds of recyclable, then the perforations in the plurality of sub-liner bags are severed, separating them from each other for independent removable, closing, and processing. A hoop removably secures the peripheral flange of the liner bag onto the container, prior to removal thereof.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The sole FIGURE of the drawing is an exploded diagrammatic perspective view of the present invention.

LIST OF REFERENCE NUMERALS UTILIZED IN THE DRAWING

10 compartmentalized trash can for sorting and storing different kinds of recyclables of the present invention
12 different kinds of recyclables
14 container for storing different kinds of recyclables 12
16 plurality of partitions for sorting different kinds of recyclables 12 to be stored in container 14
18 lid
20 apparatus for opening lid 18 by use of foot of user
22 bottom wall of container 14
24 perimeter of bottom wall 22 of container 14
26 side wall of container 14
28 uppermost terminal rim of side wall 26 of container 14
30 chamber in container 14
32 top of container 14
34 uppermost terminal edges of plurality of partitions 16
35 plurality of sub-chambers of chamber 30 in container 14 for storing different kind of different kinds of recyclables 12
36 hinge
38 foot pedal of apparatus 20 for allowing lid 18 to open when foot pedal 38 of apparatus 20 is depressed by foot of user
40 liner bag for storing different kinds of recyclables 12
42 top of liner bag 40
44 peripheral flange defining top 42 of liner bag 40
46 plurality of sub-liner bags of liner bag 40
48 top of each sub-liner bag of plurality of sub-liner bags 46 of liner bag 40
50 flange defining top 48 of each sub-liner bag of plurality of sub-liner bags 46 of liner bag 40
52 perforations in flanges 50 of plurality of sub-liner bags 46 of liner bag 40
54 hoop
56 cutouts in hoop 54

DESCRIPTION OF THE PREFERRED EMBODIMENT

Referring now to the figures, in which like numerals indicate like parts, and particularly to the sole figure, which is an exploded diagrammatic perspective view of the present invention, the compartmentalized trash can for sorting and storing different kinds of recyclables of the present invention is shown generally at 10 for sorting and storing different kinds of recyclables 12.

The compartmentalized trash can for sorting and storing different kinds of recyclables 10 comprises a container 14 for storing the different kinds of recyclables 12.

The compartmentalized trash can for sorting and storing different kinds of recyclables 10 further comprises a plurality of partitions 16 disposed in the container 14 for sorting the different kinds of recyclables 12 to be stored in the container 14.

The compartmentalized trash can for sorting and storing different kinds of recyclables 10 further comprises a lid 18 hingedly attached to, and selectively opening and closing, the container 14.

The compartmentalized trash can for sorting and storing different kinds of recyclables 10 further comprises apparatus 20 for opening the lid 18 by use of a foot of a user.

The container 14 has a bottom wall 22 with a perimeter 24, a side wall 26 that extends upwardly from the perimeter 24 of the bottom wall 22 of the container 14, to an uppermost terminal rim 28, and together with the bottom wall 22 of the container 14 define a chamber 30 in the container 14, and a top 32 that is open and communicates with the chamber 30 in the container 14 and is defined by the uppermost terminal rim 28 of the side wall 26 of the container 14.

The plurality of partitions 16 are flat and thin, and extend longitudinally through the chamber 30 in the container 14, from the bottom wall 22 of the container 14, to uppermost terminal edges 34, at the open top 32 of the container 14, and laterally, and possibly radially, across the chamber 30 in the container 14 to the side wall 26 of the container 14.

The plurality of partitions 16 divide the chamber 30 in the container 14 into a plurality of sub-chambers 35, with each sub-chamber 35 in the container 14 for storing a different kind of the different kinds of recyclables 12.

The lid 18 selectively opens and closes the top 32 of the container 14, and is hingedly attached to the uppermost terminal rim 28 of the side wall 32 of the container 14, by a hinge 36.

The apparatus 20 includes a foot pedal 38 that is operatively connected to the container 14, at the bottom wall 22 of the container 14, and operatively connected to the lid 18 for allowing the lid 18 to open when the foot pedal 38 of the apparatus 20 is depressed by the foot of the user.

A typical apparatus 20 is taught by U.S. Pat. No. 4,953,740 to Koda, which is incorporated herein by reference thereto, and as such, its teachings are to supplement the disclosure of the instant application, as was allowed in the recent decision in Robotic Vision Systems, Inc. v. View Engineering, Inc., 112 F.3d 1163, 42 USPQ.2d 1619 (Fed. Cir. 1997), where the Court held:

> "Knowledge of a skilled artisan may supplement the disclosure."[Emphasis added]

And, in Young Dental Manufacturing Company, Inc. v. Q3 Special Products, Inc., 112 F.3d 1137, 42 USPQ.2d 1589 (Fed. Cir. 1997), where the Court held:

> "An inventor must only disclose information that would not have been apparent to a skilled artisan."[Emphasis added]

And, in Genentech, Inc. v. Novo Nordisk, Als, 108 F.3d 1361, 42 USPQ.2d 1001 (Fed. Cir. 1997), where it was held:

> "A specification need not disclose what is well known in the art.

The compartmentalized trash can for sorting and storing different kinds of recyclables 10 further comprises a liner bag 40 removably lining the chamber 30 in the container 14 for storing the different kinds of recyclables 12, and having a top 42 that is open and defined by a peripheral flange 44 that rests on the uppermost terminal edge 28 of the side wall 26 of the container 14.

The liner bag 40 comprises a plurality of sub-liner bags 46 that are formed together as one piece, with each sub-liner bag of the plurality of sub-liner bags 46 lining an associated sub-chamber of the plurality of sub-chambers 35 in the container 14.

Each sub-liner bag of the plurality of sub-liner bags 46 of the liner bag 40 has a top 48 that is opened and defined by a flange 50 that extends to the peripheral flange 44 of the liner bag 40 and rests on an associated uppermost terminal edge 34 of the plurality of partitions 16.

The flanges 50 of adjacent sub-liner bags of the plurality of sub-liner bags 46 of the liner bag 40 are common, and solely by themselves, without any other attachments, attach the sub-liner bags of the plurality of sub-liner bags 46 of the liner bag 40 to each other so as to allow each sub-liner bag of the plurality of sub-liner bags 46 to extend away from, but not detached from, each other and line an associated sub-chamber of the plurality of sub-chambers 35 in the container 14.

Even though "without any other attachments" may be considered a negative limitation by some, it is the only way, and by far the clearest way, to state the limitation, and therefore must be considered in determining patentability. Support for this assertion can be found in the notice entitled "Practice Re: Technical Rejections," dated Apr. 30, 1965 (814 O.G. 715), which states that:

> "The inclusion of a negative limitation shall not, in itself, be considered a sufficient basis for objection to or rejection of a claim."[Emphasis added]

And, in In re Duva, 156 USPQ 90, 94 (CCPA 1967), where the Court stated:

> ". . . it [is] held proper to claim a negative limitation even if a positive expression could have been employed and even at the 'point of novelty'. . . "[Emphasis added]

The flanges 50 of the plurality of sub-liner bags 46 of the liner bag 40 are divided lengthwise by perforations 52.

When the plurality of sub-liner bags 46 of the liner bag 40 are inserted into associated sub-chambers of the plurality of sub-chambers 35 in the container 14, and the peripheral flange 44 of the liner bag 40 rests on the uppermost terminal edge 28 of the side wall 26 of the container 14, and the flanges 50 of the plurality of sub-liner bags 46 of the liner bag 40 rest on the uppermost terminal edges 34 of the plurality of partitions 16, and the plurality of sub-liner bags 46 of the liner bag 40 become filled with the different kinds of recyclable 12, then the perforations 52 in the flanges 50 of the plurality of sub-liner bags 46 of the liner bag 40 are severed, separating the plurality of sub-liner bags 46 of the liner bag 40 from each other for independent removable, closing, and processing.

The compartmentalized trash can for sorting and storing different kinds of recyclables 10 further comprises a hoop 54 removably securing the peripheral flange 44 of the liner bag 40 onto the uppermost terminal rim 28 of the side wall 26 of the container 14, prior to removal thereof.

The hoop 54 is channel-shaped in lateral cross section and engages the uppermost terminal edge 28 of the side wall 26 of the container 14, with the peripheral flange 44 of the liner bag 44 removably captured therebetween, and has cutouts 56 to clear the plurality of partitions 16.

It will be understood that each of the elements described above, or two or more together, may also find a useful application in other types of constructions differing from the types described above.

While the invention has been illustrated and described as embodied in a compartmentalized trash can for sorting and storing different kinds of recyclables, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A compartmentalized trash can for sorting and storing different kinds of recyclables, said can comprising:

a) a container for storing the different kinds of recyclables; said container having:
   i) a bottom wall with a perimeter;
   ii) a side wall extending upwardly from said perimeter of said bottom wall of said container, to an uppermost terminal rim, and together with said bottom wall of said container defining a chamber in said container; and
   iii) a top being open and communicating with said chamber in said container and being defined by said uppermost terminal rim of said side wall of said container;

b) a plurality of partitions disposed in said container for sorting the different kinds of recyclables to be stored in said container; said plurality of partitions extending longitudinally through said chamber in said container, from said bottom wall of said container, to uppermost terminal edges, at said open top of said container, and laterally across said chamber in said container to said side wall of said container; said plurality of partitions dividing said chamber in said container into a plurality of sub-chambers, with each sub-chamber in said container for storing a different kind of the different kinds of recyclables;

c) a lid hingedly attached to, and selectively opening and closing, said container:

d) means for opening said lid by use of a foot of a user; and e) a liner bag removably lining said chamber in said container for storing the different kinds of recyclables, and having a top that is open and defined by a peripheral flange that rests on said uppermost terminal edge of said side wall of said container; said liner bag comprising a plurality of sub-liner bags being formed together as one piece, with each sub-liner bag of said plurality of sub-liner bags lining an associated sub-chamber of said plurality of sub-chambers in said container.

2. The can as defined in claim 1, wherein said plurality of partitions are flat and thin.

3. The can as defined in claim 1, wherein said plurality of partitions extend longitudinally through said chamber in said container, from said bottom wall of said container to said open top of said container, and laterally radially across said chamber in said container to said side wall of said container.

4. The can as defined in claim 1, wherein said lid selectively opens and closes said top of said container.

5. The can as defined in claim 1, wherein said lid is hingedly attached to said uppermost terminal rim of said side wall of said container, by a hinge.

6. The can as defined in claim 1, wherein said means includes a foot pedal that is operatively connected to said container, at said bottom wall of said container, and operatively connected to said lid for allowing said lid to open when said foot pedal is depressed by the foot of the user.

7. The can as defined in claim 1, wherein each sub-liner bag of said plurality of sub-liner bags of said liner bag has a top that is opened and defined by a flange that extends to said peripheral flange of said liner bag and rest on an associated uppermost terminal edge of said plurality of partitions.

8. The can as defined in claim 7, wherein said flanges of adjacent sub-liner bags of said plurality of sub-liner bags of said liner bag are common, and solely by themselves, without any other attachments, attach said sub-liner bags of said plurality of sub-liner bags of said liner bag to each other so as to allow each sub-liner bag of said plurality of sub-liner bags to extend away from but not detached from, each other and line an associated sub-chamber of said plurality of sub-chambers in said container.

9. The can as defined in claim 7, wherein said flanges of said plurality of sub-liner bags of said liner bag are divided lengthwise by perforations, and when said plurality of sub-liner bags of said liner bag are inserted into associated sub-chambers of said plurality of sub-chambers in said container, and said peripheral flange of said liner bag rests on said uppermost terminal edge of said side wall of said container, and said flanges of said plurality of sub-liner bags of said liner bag rest on said uppermost terminal edges of said plurality of partitions, and said plurality of sub-liner bags of said liner bag become filled with the different kinds of recyclable, then said perforations in said flanges of said plurality of sub-liner bags of said liner bag are severed, separating said plurality of sub-liner bags of said liner bag from each other for independent removable, closing, and processing.

10. The can as defined in claim 1; further comprising a hoop removably securing said peripheral flange of said liner bag onto said uppermost terminal rim of said side wall of said container, prior to removal thereof.

11. The can as defined in claim 10, wherein said hoop is channel-shaped in lateral cross section and engages said uppermost terminal edge of said side wall of said container, with said peripheral flange of said liner bag removably captured therebetween.

12. The can as defined in claim 10, wherein said hoop has cutouts to clear said plurality of partitions.

* * * * *